US005090221A

United States Patent [19]

Sewter et al.

[11] Patent Number: 5,090,221

[45] Date of Patent: Feb. 25, 1992

[54] CONTINUOUS CIRCULATION WATER WASH APPARATUS AND METHOD FOR CLEANING RADIOACTIVELY CONTAMINATED GARMENTS

[75] Inventors: Bruce R. Sewter, Browns Mills, N.J.; Lester Clemons, Jr., Monroeville; Joseph A. Battaglia, Forest Hills, both of Pa.; Thomas A. DeBarber, Cayucos, Calif.

[73] Assignee: Westinghouse Electric Corp., Pittsburgh, Pa.

[21] Appl. No.: 277,846

[22] Filed: Nov. 30, 1988

[51] Int. Cl.[5] ..... D06F 43/08

[52] U.S. Cl. ..... 68/18 R; 68/18 F; 210/167

[58] Field of Search ..... 68/18 R, 18 C, 18 F; 8/142, 137; 210/167; 202/170; 134/109

[56] References Cited

U.S. PATENT DOCUMENTS

| | | | |
|---|---|---|---|
| 2,558,628 | 6/1951 | Redin | 134/103 X |
| 3,079,206 | 2/1963 | Kearney et al. | 134/103 X |
| 3,085,415 | 4/1963 | Gosnell . | |
| 3,170,314 | 2/1965 | Worst | 68/18 F X |
| 3,441,035 | 4/1969 | Edwards | 134/103 |
| 3,459,201 | 8/1969 | Wazne et al. | 134/103 X |
| 3,746,508 | 7/1973 | Landon | 68/18 F |
| 3,786,825 | 1/1974 | Weisner | 134/103 X |
| 4,235,600 | 11/1980 | Capella et al. . | |
| 4,235,677 | 11/1980 | Karamian | 137/577 X |
| 4,601,181 | 7/1986 | Privat | 68/18 F X |
| 4,738,272 | 4/1988 | McConnell | 134/95 X |
| 4,770,197 | 9/1988 | Prisco, Jr. et al. . | |
| 4,781,041 | 11/1988 | Fowler | 68/18 R X |
| 4,797,128 | 1/1989 | Fowler | 68/18 R X |
| 4,820,421 | 4/1989 | Auerswald | 210/670 |
| 4,879,888 | 11/1989 | Suissa | 68/18 F X |
| 4,909,050 | 3/1990 | Sewter et al. | 68/18 F |

FOREIGN PATENT DOCUMENTS

| | | | |
|---|---|---|---|
| 162489 | 9/1984 | Japan . | |
| 63-82699 | 4/1988 | Japan | 68/18 R |

OTHER PUBLICATIONS

Co-pending U.S. patent application Ser. No. 162,454 filed Mar. 1, 1988, entitled "Water Washing Apparatus and Method for Cleaning Radioactively Contaminated Garments".

Brochure—"ETI Eastern Tehcnologies, Inc."—ETI Introduces Mobile Water Wash Laundry Systems.

Co-pending U.S. patent application Ser. No. 06/832,491 Filed Feb. 21, 1986 for "Method and Apparatus for Recovering Solvent" by Anthony Prisco.

*Primary Examiner*—Frankie L. Stinson

[57] ABSTRACT

Both an apparatus and method for water washing garments in order to remove particulate radioactive contaminants therefrom is disclosed herein. The apparatus generally comprises a washing machine having a wash-water inlet, a rinse-water inlet, a circulation inlet, a water outlet and a particulate removal system connected between the circulation inlet and the water outlet of the washing machine for circulating water introduced into the washing machine between two and three times through a filtration bank while the machine washes or rinses the garments. The apparatus also includes a hydraulically closed wash-water system having a polished wash-water reservoir connected to the wash-water inlet of the washing machine, as well as a hydraulically closed rinse-water system having a polished rinse-water reservoir connected to the rinse-water inlet of the machine. Both the wash-water system and the rinse-water system also have water polishers for removing dissolved radionucleides from the clothing. The particulate removal system effectively counteracts the tendency of the garments to trap particulate radioactive contaminants during both the wash and rinse cycles, and provides more effective decontamination of the garments in shorter wash and rinse times.

19 Claims, 2 Drawing Sheets

CONTINUOUS CIRCULATION WATER WASH APPARATUS AND METHOD FOR CLEANING RADIOACTIVELY CONTAMINATED GARMENTS

BACKGROUND OF THE INVENTION

This invention generally relates to garment cleaning apparatuses and methods, and is specifically concerned with a continuous circulation water wash which more effectively removes particulate radioactive contaminants from the garments worn by maintenance personnel who service nuclear power facilities.

Machines for cleaning radioactively contaminated clothing are known in the prior art. Such prior art clothing may use either a dry cleaning technique or a water wash technique to achieve the desired end. Of the two techniques, dry cleaning with the use of fluorocarbon solvents such as Freon® is presently preferred over known water wash type machines due to the generally superior penetrating ability of fluorocarbon solvents. However, before the relative advantages and disadvantages of these two types of techniques can be fully appreciated, some background of the nature of the clothing cleaned and the environment wherein it is used is necessary.

Present-day nuclear power facilities require various maintenance and operating personnel to work in areas which may be contaminated with radioactive particles. To prevent these radioactive particles from coming into contact with the skin of such personnel, protective clothing in the form of frocks, hoods and shoe coverings (known as "duck feet" in the art) are worn. After use, it is essential that the clothing be cleaned in such a way that removes substantially all of the radioactive particulates, and all or at least most of the conventional soils, sweats and body salts that also accumulate therein. The removal of certain rare but highly radioactive particulates, such as the "fuel fleas" which may be generated by the cracking of a fuel rod, is particularly important as such particles are capable of exposing a small, pinpoint area of skin to a dangerous level of radioactivity. However, the cost of performing such a cleaning must be substantially less than the cost of replacing the garment if the cleaning is to be cost effective. If the cost of cleaning approaches the cost of disposing of the old garment and replacing it with another, then garment replacement becomes preferable to garment cleaning.

Dry cleaning techniques for cleaning such radioactively contaminated clothing are presently in greater use than water wash techniques due to the inherently lower surface tension and hence generally superior penetrating ability of the fluorocarbons used in such techniques. While such fluorocarbons have proven effective in removing substantially all of the radioactive particulates from the clothing, these dry cleaning techniques are not without shortcomings. For example, the fluorocarbons used can dissolve the elastomers in synthetic rubbers that form parts of boots and other shoe coverings used in maintenance operations. The dissolution of these elastomers causes the synthetic rubbers to become brittle and to crack, thereby damaging and ultimately destroying the particular article of clothing containing the synthetic rubber. Other materials used in protective clothes and shoes such as Neoprene® tend to soak up and absorb these fluorocarbons until unacceptable levels of these fluorocarbons build up in the articles of clothing. These excess fluorocarbons can be dried out of the clothing by the application of additional amounts of heat. However, the addition of such a dry-out step in the cleaning process adds to the overall expense of cleaning, and may tend to heat damage the plastic and rubber portions of the clothing, thereby defeating the purpose of the extra dry-out. Still another shortcoming associated with dry cleaning techniques is the limited ability of fluorocarbons to dissolve sweat and body salts. Even though the fluorocarbons may succeed in removing substantially all of the radioactive particulates, the accumulation of such sweat and body salts will ultimately give the garment a cumulative "locker room" odor. Worse yet, these fluorocarbons are limited (as are most organic solvents) in their ability to dissolve and to remove radioactive contaminants in the form of metallic salt, such as cesium 137. Finally, all known devices which clean such clothing by means of fluorocarbons release significant amounts of these fluorocarbons into the air, which may be damaging to the layer of ions in the atmosphere which blocks ultraviolet radiation of the sun. This last problem has induced the U.S. Environmental Protection Agency to promulgate new regulations which will become effective in 1989 that substantially restrict the use of such fluorocarbons.

While wet washing techniques avoid many of the aforementioned shortcomings associated with dry cleaning techniques, they too have their drawbacks, the most serious being the generation of a water effluent which contains the radioactive particles removed from the clothing. The transportation and disposal of such an effluent significantly contributes to the cost of the wash, notwithstanding the fact that the effluent qualifies as low radioactive waste. Even though most nuclear facilities have on-site demineralizer systems which are capable of decontaminating such water, the inconveniences and expenses associated with the use of such on-site demineralizer systems also add substantially to the overall cost of such prior art water wash techniques. Still another problem is the relatively lower efficiency of the water used in such systems in penetrating the fabrics that form such clothing. The relatively lower penetrating ability of water coupled with the greater effort needed for dry out due to the lower volatility of water as compared to Freon® generally has the negative effect of increasing the time necessary to effectively water wash a contaminated garment.

To address these concerns, Westinghouse Radiological Services, Inc., (a wholly owned subsidiary of the Westinghouse Electric Corporation) has developed an improved water wash system which utilizes hydraulically isolated wash and rinse-water systems that include water polishers for providing demineralized and filtered water to a washing machine for every wash cycle and rinse cycle. This invention is described and claimed in co-pending U.S. Pat. application Ser. No. 162,454, filed Mar. 1, 1988 and assigned to the Westinghouse Electric Corporation, the entire specification of which is expressly incorporated herein by reference. While this water wash system and method represents a substantial advance in the art, it, too has a shortcoming which limits its effectiveness in removing radioactive particles from the garments that it washes. Specifically, the applicants have observed that the amount of particulate contaminants which are removed from the garments during each wash or rinse cycle is significantly less than the amount of particulate contaminants that the surfactants in the wash-water actually dislodge from the fabric forming the clothing.

Clearly, there is a need for the garment washing apparatus and method which retains all of the advantages associated with the latest water wash system, but which is more effective in removing radioactive particles from the interior of the washing machine once they are dislodged from the garments so that they will not re-lodge back into the garments at the termination of a wash or a rinse cycle. Such a device would have the ability to render a garment free of such particulate contaminants with a minimum number of wash and rinse cycles, and in a minimum amount of time.

SUMMARY OF THE INVENTION

Generally speaking, the invention is both an apparatus and method for water washing radioactively contaminated garments which overcomes the disadvantages associated with prior art systems by constantly circulating both the wash and rinse-water through a particulate removal system during the wash and rinse cycles. To this end, the apparatus comprises a washing machine having a wash-water inlet, a rinse-water inlet, a circulation inlet, and a water outlet, a particulate removal system connected between the circulation inlet and the water outlet for continuously circulating water introduced into the washing machine through a particulate removal means (which may be a bank of serially-connected filters,) and hydraulically closed wash-water and rinse-water systems, each of which includes a polished water reservoir connected to the wash-water inlet and the rinse-water inlet, respectively, for supplying polished wash-water and polished rinse-water to the washing machine.

The particulate removal system includes a pump having sufficient flow capacity to completely circulate the volume of wash-water or rinse-water introduced into the washing machine between two and three times during either a wash or a rinse cycle. Additionally, the filters which form the particulate removal means preferably include a 25 micron, 5 micron and 1 micron cartridge-type filter which are serially connected together with the 25 micron filter upstream of the other two in order to remove the largest particulate contaminants first. To ensure continuous operation even during a filter replacement, the particulate removal system may also include a redundant bank of three additional, serially connected cartridge-type filters which are connected in parallel to the first bank of filters. Isolation valves are provided between the two filter banks so that either bank may be operated in hydraulic isolation with respect to the other. If a greater circulation rate is required, these same valves allow both banks to be operated simultaneously in parallel in order to reduce the back pressure that the filter banks impose on the circulating water.

The hydraulically closed wash-water system includes a wash-water polisher connected to the inlet of the wash-water reservoir for supplying polished wash-water to the reservoir. The inlet of the washwater polisher is in turn connected to a wash collection tank located downstream of the water outlet of the washing machine. A wash-water filtration bank is hydraulically connected between the wash collection tank and the inlet of the water polisher in order to remove all radioactive particulates which escaped entrapment by the filter banks of the particulate removal means.

The hydraulically closed rinse-water system also includes a water polisher having deionizer beds connected to the inlet of the rinse-water reservoir. In contrast to the wash-water polisher, the rinse-water polisher is provided with charcoal beds for removing residual surfactants from the rinse-water. A rinse-water collection tank is hydraulically disposed between the outlet of the washing machine and the inlet of the rinse-water polisher.

The rinse-water system is selectively connectable to the wash-water system by way of a check valve so that makeup wash-water may be provided by the rinse-water system. Finally, both the wash-water system and the rinse-Water system include an ultraviolet purifier to destroy micro-organisms in the water which might tend to reproduce within the deionizer beds and columns provided in both the wash-water and the rinse-water polisher.

In the method of the invention, the wash-water or rinse-water introduced within the washing machine is circulated through the filtration bank of the particulate removal system between two and three times during each wash or rinse cycle. These circulations have the effect of removing approximately 90 per cent of all the particulate radioactive contaminants in the garments being washed, thus effectively counteracting the tendency of the garments to "trap" such particulate contaminants when the washing machine is drained after each wash and rinse cycle.

BRIEF DESCRIPTION OF THE SEVERAL FIGURES

FIGS. 1A and 1B are a schematic diagram of the hydraulic circuit used in the apparatus of the invention.

DETAILED DESCRIPTION OF THE PREFERRED EMBODIMENT

Figure 1A:
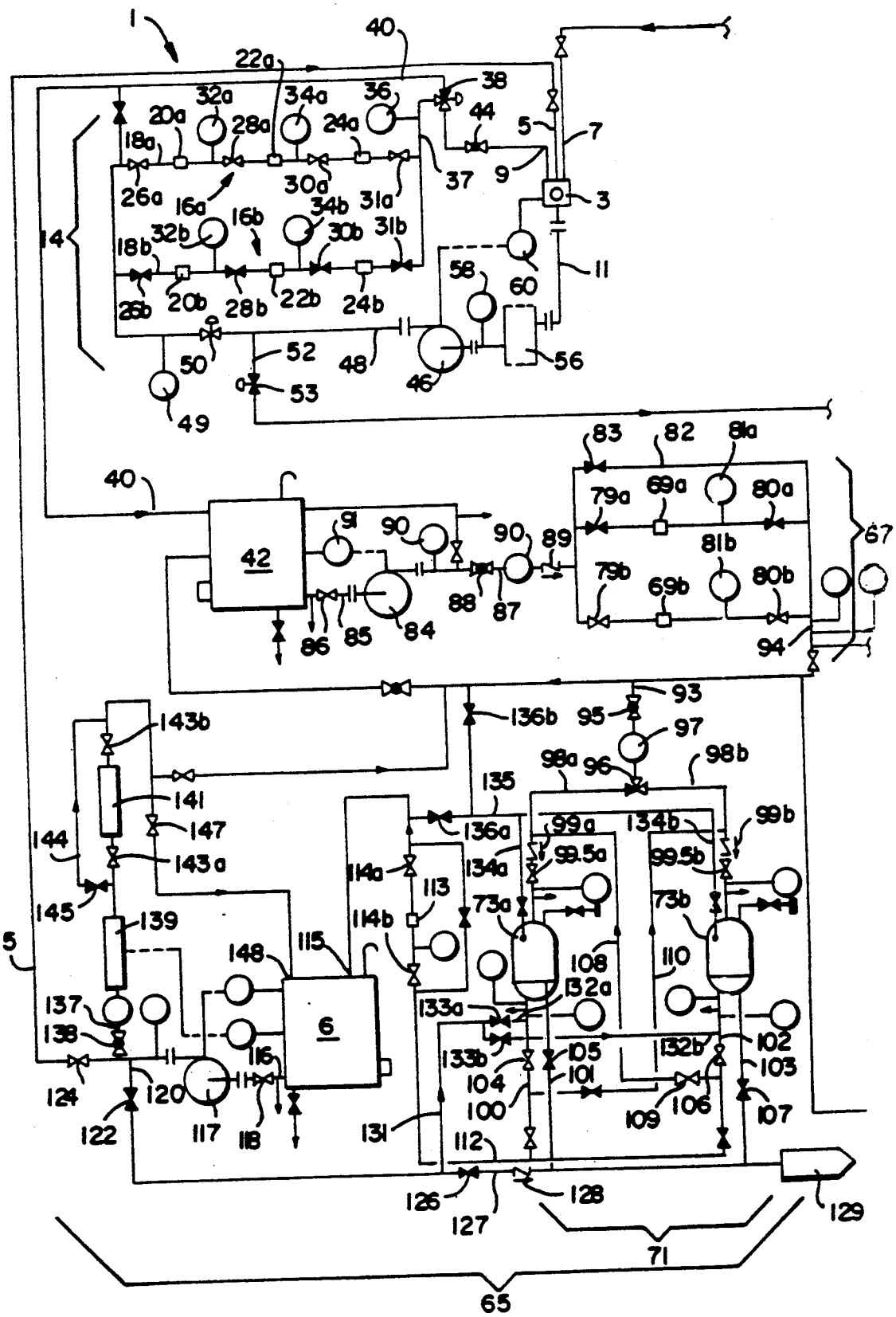
Figure 1B:
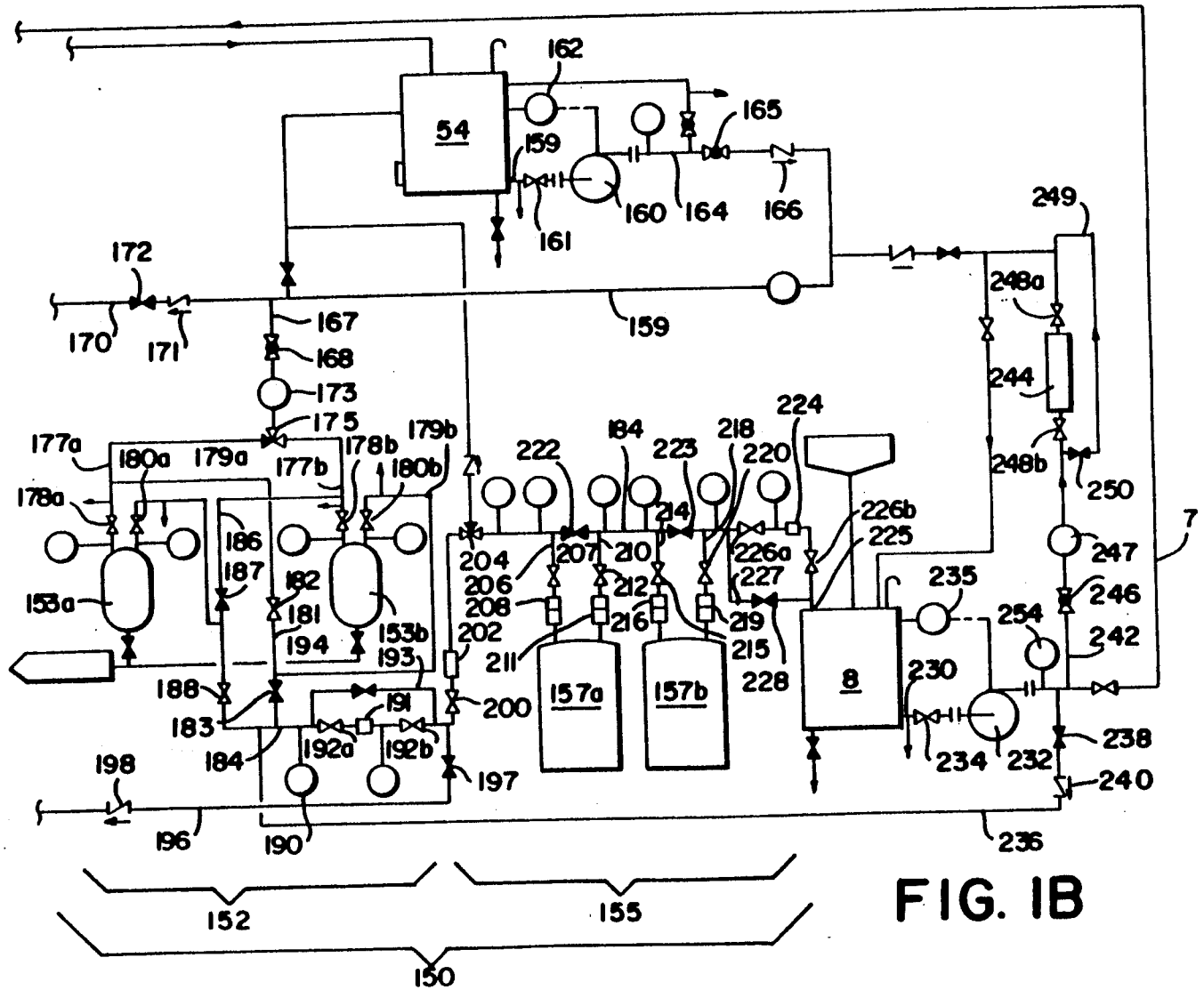

With reference now to FIGS. 1A and 1B, wherein the black valves are normally closed and the white valves are normally open, the water wash system 1 of the invention includes a three hundred pound capacity washing machine 3 as shown. In the preferred embodiment, the washing machine 3 is a "Frontalex" Model 1300 type washing machine manufactured by S.A. E.M. D'Hooge located in Ledeburg, Belgium. Such machines are capable of washing between 250 and 350 pounds of clothes in approximately 200 to 250 gallons of water. The washing machine 3 includes a wash-water inlet conduit 5 connected to a reservoir 6 of polished wash-water, a rinse-water conduit 7 which is similarly connected to a reservoir 8 of polished rinse-water, and a circulation inlet conduit 9. The machine 3 further includes an outlet conduit 11 for discharging either wash or rinse-water introduced into the machine 3 by way of conduits 5 or 7. In the preferred embodiment, the outlet conduit 11 is a pipe having an inner diameter of approximately six inches. The use of such a relatively large-diametered pipe as the outlet conduit 11 allows the machine 3 to rapidly "dump" whatever wash or rinse-water it contains into a sump 56 which helps to prevent particulate contaminants suspended in the water from depositing themselves on either the clothes or the interior walls of the washing machine 3 when wash or rinse-water is discharged from the machine 3.

A particulate removal system 14 is connected between the circulation inlet conduit 9 in the outlet conduit 11 of the washing machine 3. This removal system 14 includes a pair of parallel filtration banks **16*a* and 16*b* hydraulically connected to conduits 18*a* and 18*b* respectively. Each of the filtration banks 16*a*, 16*b* includes serially connected twenty-five micron filters 20*a*, 20*b*,** five micron filters 22a, 22b and one micron filters 24a, 24b, respectively. The twenty-five micron filters 20a, 20b and five micron filters 22a, 22b are located upstream of the one micron filters 24a and 24b so that the larger particulate contaminants are removed before they have an opportunity to lodge themselves in the five micron and one micron filters and clog them up. The filtration banks 16a and 16b further include isolation valves 26a, 26b, 28a, 28b, 30a, 30b, and 31a, 31b. These isolation valves advantageously allow any of the filters in either of the filtration banks 16a, 16b to be removed during the operation of the particulate removal system 14. These valves also allow either one or both of the filtration banks 16a, 16b to be placed on-line during the operation of the system 14. Under ordinary operating conditions, only one of the filtration banks 16a will be placed on-line, the remaining bank 16b being held in reserve. Such an operating mode allows the system operator to change one or more of the cartridge filters 20a, 22a or 24a of the filtration system 16a without interrupting the operation of the particulate removal system 14 by merely shutting the isolation valves 26a and 31a and opening all of the isolation valves 26b, 28b, 30b and 31b of the reserve filtration bank 16b. Of course, both of the filtration banks 16a and 16b may be operated simultaneously in parallel by simply opening all of the isolation valves 26a, 26b, 28a, 28b, 30a, 30b, 31a, 31b. Such a parallel operation reduces the back pressure that the filtration banks 16a, 16b apply to the water circulating thereto, which in turn increases the number of times that the wash or rinse-water contained within the washing machine 3 circulates through the particulate removal system 14. Such a parallel mode of operation may be used when the garments being washed are particularly dirty. Pressure gauges 32a, 32b, 34a, 34b, and 36 are provided at various points between the filters 20a, 20b, 22a, 22b, and 24a, 24b so that the system operator may tell the extent to which particulate contaminants have saturated the cartridge-type filter elements contained within each of the filters 20a, 20b, 22a, 22b, 24a, and 24b.

Downstream of the filtration banks 16a and 16b is filtration bank outlet conduit 37, which is connected to the bank conduits 18a and 18b as indicated. Outlet conduit 37 includes a three way valve 38. During a wash or rinse cycle, the three way valve 38 connects the filtration bank outlet conduit 37 to the circulation inlet conduit 9 so that the wash or rinse-water contained within the washing machine 3 freely circulates out through the washing machine conduit 11, and back into the machine 3 through the conduit 9. However, at the termination of a wash cycle, the three way valve 38 diverts all of the water flowing out of the outlet conduit 37 into the wash-water outlet conduit 40, which in turn is connected to wash-water collection tank 42. As will be discussed in more detail hereinafter, the wash-water collected in the tank 42 is filtered and polished by the wash-water polisher, and returned to the polished wash-water reservoir 6 for reuse.

Upstream of the filtration banks 16a, 16b is a impeller-type circulation pump 46. This pump 46 preferably has a flow rate capacity of at least one hundred gallon per minute. The outlet of the circulation pump 46 is connected to he filtration bank inlet conduit 48. A pressure gauge 49 is provided on this conduit so that the system operator may immediately tell what the back pressure of the filtration bank 16a, 16b is. Also provided on the inlet conduit 48 is a rinse-water diverter valve 50. Upstream of the vale 50 is a rinse-water conduit 52 which also includes a rinse-water diverter valve 53. During a rinse cycle, diverter valve 50 is open and valve 53 is closed so that the circulation pump 46 circulates rinse-water within the machine 3 through the filtration banks 16a, 16b. However, at the end of each rinse cycle, diverter valve 50 is shut and valve 53 is opened so that the pump 47 will empty the rinse-water out through the outlet conduit 11 of the machine 3 and into a rinse collection tank 54. As will be discussed in detail hereinafter, the rinse-water emptied into the collection tank 54 will ultimately be polished by a rinse-water polisher and recycled back into the rinse-water reservoir 8.

Upstream of the circulation pump 46 is the previously mentioned collection sump 56. The purpose of the sump 56 is to allow the wash or rinse-water contained within the machine 3 to be rapidly dumped out of the machine through the wide outlet conduit 11 so that the water flows out of the interior of the machine 3 in a relatively short time. As has been indicated previously, the rapid dumping of the water from the interior of the machine 3 helps to keep particulate contaminants in suspension in the water and discourages them from redepositing themselves on either the clothes contained within the machine 3, or the interior walls of the machine 3. A pressure gauge 58 is provided between the recirculation pump 46 and the sump 56 to monitor the pressure differential therebetween, and a water level sensor 60 is hydraulically connected to the washing machine 3 and electrically connected to the recirculation pump 46 in order to actuate the pump 46 if the water level within the machine 3 rises above a desirable level.

A wash-water polisher 65 is hydraulically disposed between the wash collection tank 42 and the wash-water reservoir 6 in order to continuously resupply the reservoir 6 with polished and filtered wash-water. To this end, the wash-water polisher 65 includes a particulate filtration system 67 having a pair of parallel, one micron cartridge-type filter 69a and 69b. Polisher 65 also includes a wash-water deionizer system 71 having a pair of serially connected deionizer ion exchange beds 73a and 73b.

The filtration system 67 of the wash-water polisher 65 includes, in addition to the parallel one micron cartridge-type filters 69a, 69b, isolation valves 79a, 79b, 80a, 80b, and pressure gauges 81a and 81b. These isolation valves 79a, 79b, 80a, 80b may be used in the same manner as the isolation valves present in the filtration banks 16a, 16b of the previously described particulate removal system 14 in that they may be used to selectively operate either the filter 69a, the filter 69b, or both filters in parallel. The pressure gauges 81a and 81b inform the system operator whether or not the filters 69a or 69b are saturated with particulate matter and need to be replaced. A bypass conduit 82 having a bypass valve 83 is further provided in the filtration system 67 so that the entire system 67 may be bypassed, if desired, incident to a maintenance operation which involves both filters 69a and 69b.

A circulation pump 84 is provided upstream of the filtration system 67 and downstream of the Wash-water collection tank 42. The inlet of the pump 84 is connected to outlet conduit 85 of the wash-water collection tank 42 byway of a valve 86. The outlet of the pump 84 is connected to an inlet conduit 87 which in turn is connected back to the filtration system 67. Inlet conduit 87 includes a throttle valve 88, a check valve 89 for preventing a backflow, and a flow meter 90 for monitoring the flow rate of the water through the filtration system 67. A water level sensor 91 is hydraulically connected to the wash collection tank 42 and electrically connected to the circulation pump 84 so that the pump 84 will be automatically actuated when the level of the water in the collection tank 42 rises above a desired level.

The wash-water deionizer system 71 has an inlet conduit 93 connected to the outlet conduit 94 of the filtration system 67. Inlet conduit 93 includes a throttle valve 95 for regulating the total amount of water flowing through the conduit 93, as well as a three way permuting valve 96 which is capable of reversing the direction of flow through the serially connected deionizer beds 73*a* and 73*b*. Inlet conduit 93 additionally has a flow meter 97 so that the flow rate between the filtration system 67 and the deionizer beds 73*a* and 73*b* may be monitored.

Each of the deionizer beds 73*a*, 73*b* includes an inlet conduit 98*a*, 98*b*. Each of these inlet conduits 98*a*, 98*b* in turn has a check valve 99*a*, 99*b* incorporated therein to prevent back flow, as well as an isolation valve 99.5*a*, 99.5*b*. Each of the deionizer beds 73*a* and 73*b* is provided with an outlet conduit 100, 102, as well as a resin release conduit 101 and 103, respectively. The purpose of the resin release conduits 101 and 103 is to allow the system operator to discharge spent deionizer resins from each of the deionizer beds 73*a*, 73*b* when these resins become saturated. Each of the outlet conduits 100 and 102 includes isolation valves 104 and 106 respectively, while each of the resin release conduits 101 and 103 includes a resin release valve 105 and 107. Two crossover conduits 108, 110 serially interconnect the deionizer beds 73*a* and 73*b*. Each of these conduits 108, 110 includes a valve 109 and 111 as indicated. The direction in which the water flows relative to the two deionizer beds 73*a* and 73*b* may be changed by way of valves 96, 111 and 113. If the three way permuting valve 96 is adjusted so that all of the flow through the conduit 93 is diverted through the inlet conduit 98*a* of the deionizer bed 73*a*, crossover valve 111 will be open while crossover valve 109 will be closed, thereby routing the water completely through the deionizer bed 73*a*, through the outlet conduit 100, through the crossover conduit 110, and into the inlet conduit 98*b* of the deionizer bed 73*b*. Conversely, if it is desired to route the water flowing through the inlet conduit 93 into the deionizer bed 73*b* first, the three way permuting valve 96 will be adjusted accordingly, and the crossover valve 109 will be opened while crossover valve 111 will be closed. Such a valving configuration will route the water through the inlet conduit 98*b*, through the deionizer bed 73*b* and through outlet conduit 102, and onward through crossover conduit 108 and into inlet conduit 98*a*. An outlet conduit 112 is provided downstream of both of the deionizer beds 73*a* and 73*b*. Included within the outlet conduit 112 is a resin trap 113 in the form of a 25 micron cartridge-type filter. Resin trap 113 prevents fine particulate matter dislodged out of the deionizer beds 73*a* and 73*b* from flowing through the outlet conduit 112 and ultimately into the polished wash-water reservoir 6. Isolation valves 114*a* and 114*b* are provided upstream and downstream of the resin trap 113 so that the cartridge type, 25 micron filter disposed therein may be easily changed. The output of the resin trap 113 flows directly into an inlet 115 of the polished wash-water reservoir 6 as is indicated.

The outlet of the polished wash-water reservoir is connected to an outlet conduit 116 which leads into the inlet of a circulation pump 117 by way of a valve 118. A flush water conduit 120 is connected immediately downstream of the outlet of the pump 117 as shown in the schematic diagram. This flush water conduit !20 includes a flush water valve 122 which works in cooperation with blocking valve 124 provided in the wash-water inlet conduit 5 to route the output of the pump 117 either completely through the conduit 5, or completely through the flush water conduit 120. Downstream of the flush water valve 122 is a flush routing valve 126. Valve 126 controls whether the flush water directed to the conduit 120 will be used to back-wash the deionizer beds 73*a*, 73*b* or to flush spent resins discharged through the resin release conduits 101 and 103 into a resin discharge container 129. A check valve 128 is provided downstream of the routing valve 126 to prevent backflow. A back-wash conduit 131 is disposed upstream of the routing valve 126 so that when routing valve 126 is closed, flush water flowing through the conduit 120 will be routed up through the bottom of the deionizer beds 73*a*, 73*b* by way of backwash inlet conduits 132*a*, 132*b* and routing valves 133*a* and 133*b*. Back wash outlet conduits 134*a* and 134*b* are provided near the top ends of each of the deionizer beds 73*a* and 73*b*. These two back-wash outlet conduits 134*a* and 134*b* ultimately converge into a single backwash conduit 135. Back-wash water flowing through conduit 135 may be routed back to the polished wash-water reservoir 6 by way of valve 136*a*, or up into the wash-water collection tank 42 by way of valve 136*b*.

Also disposed downstream of the outlet of the pump 117 is a heater and purifier conduit 137. A valve 138 is disposed at the upstream end of the heater and purifier conduit 137 to selectively direct the output of the pump 117 through an in-line wash-water heater 139 (capable of heating the wash-water to 140 degrees F.), and from thence to an ultraviolet purifier 141 (which advantageously kills microorganisms in the polished wash-water which could reproduce in and ultimately clog the deionizer beds 73*a* and 73*b*). A bypass conduit 144 and bypass valve 145 are provided across the ultraviolet purifier 141 so that the purifier 141 may be bypassed in the event of a malfunction or a maintenance operation. The heater and purifier conduit 137 is connected to a circulation inlet 148 provided near the top of the polished wash-water reservoir 6.

The rinse-water polisher 150 is generally comprised of a charcoal filtration system 152 that includes a pair of serially connected charcoal beds 153*a* and 153*b*, and a rinse-water deionizer system formed from a pair of serially connected deionizer columns 157*a* and 157*b*. Just upstream of the rinse-water polisher 150 is the outlet conduit 159 of the previously mentioned rinse-water collection tank 54. This outlet conduit 159 is connected to the inlet of the rinse-water collection pump 160 by way of a valve 161. A water lever sensor is hydraulically connected to the rinse-water connection tank 154 and electrically connected to the collection pump 160 to automatically lower the water level in the tank 154 should it rise above a desired level. The output of the pump 160 is connected to an outlet conduit 164 that includes a throttle valve 165, and a check valve 166 for preventing backflow. Downstream of the check valve 166, the outlet conduit 164 of the collection pump 160 is connected to the inlet conduit 167 of the charcoal filtration system 152. Inlet conduit 167 includes a throttle valve 168 as shown which is capable of completely blocking the flow of water from the rinse-water collection tank 54 to the charcoal filtration system 152. Downstream of the connection between the outlet conduit 159 and the inlet conduit 167 is a first make-up water conduit 170. The check valve 171 and flow valve 172 are provided between the outlet conduit 159 of the collection pump 160 and the first make-up water conduit 170 to prevent backflow therethrough. The purpose of the conduit 170 is to provide make-up water from the rinse-water system 150 to the wash system 65 on as-needed basis. Such an arrangement avoids a separate interface between the wash-water system 65 and an outside water supply.

The inlet conduit to the charcoal filtration system 152 includes, in addition to the previously mentioned throttle valve 168, a flow meter 173 and a three way permuting valve 175. The valve 175 is capable of routing all of the rinse-water entering the inlet conduit 167 to either the inlet conduit 177*a* of the charcoal bed 153*a*, or the inlet conduit 177*b* of the charcoal bed 153*b*. Each of the charcoal bed inlet conduits 177*a*, 177*b* includes an upstream isolation valve 178*a*, 178*b*. Each of the charcoal beds 153*a*, 153*b* is further provided with an outlet conduit 179*a*, 179*b* having a downstream isolation valve 180*a*, 180*b*. A crossover conduit 181 having a valve 182 serially connects the charcoal beds 153*a*, 153*b*. The crossover conduit 181 is further connected to an outlet conduit 184 by way of a diverter valve 183. A second crossover conduit 186 also serially connects the charcoal beds 153*a*, 153*b* of the charcoal filtration system 152. Like crossover conduit 181, this conduit 186 also includes a valve 187, and is further connected to outlet conduit 184 by way of diverter valve 188. The direction of the flow through the charcoal beds 183*a* and 183*b* may be reversed by adjusting three way, permuting valve 175, and by opening and closing crossover valves 182 and 187 in same manner as was described with respect to the ion exchange beds 73*a*, 73*b* of the wash-water polisher 65. A particulate charcoal trap 191 in the form of a 25 micron filter is provided in the outlet conduit 184 of the charcoal filtration system 152 downstream of a pressure gauge 190. This trap 191 includes a 25 micron, cartridge-type filter element which may be changed when the flanking isolation valve 182*a*, 192*b* are closed. A bypass conduit 193 and 194 is provided so that the flow of water leaving the charcoal beds 153*a* and 153*b* may be conveniently diverted around the particulate charcoal trap 191.

A second make-up water conduit 196 is connected downstream of the particulate charcoal trap 191 located within the outlet conduit 184 of the charcoal filtration system 152. As is indicated in the schematic, this conduit 196 is connected to the outlet conduit 94 of the filtration system 67 of the wash-water polisher 65. Generally, make-up water from the second make-up water conduit 196 is preferred over make-up water of the first make-up water conduit 170, since water from the conduit 196 would have been circulated through the charcoal beds 153*a* and 153*b*. A check valve 198 is provided in the second make-up water conduit 196 to prevent backflow, and a diverter valve 197 is also provided in order to divert water flowing out of the outlet conduit 184 into the conduit 196.

An outlet valve 200 is provided at the end of the outlet conduit 184 of the charcoal filtration system 152. Downstream of the outlet valve 200 is a sight glass 202 whose primary purpose is to inform the system operator whether or not particulate charcoal is entrained within the water leaving the charcoal beds 153*a* and 153*b*. A three way valve 204 is located downstream of the sight glass 202. This valve 204 is normally open in order to allow the water flowing out of the charcoal filtration system 152 to enter the deionizer columns 157*a*, 157*b* of the rinse-water deionizer system 155. As is indicated in the schematic, the deionizer columns 157*a*, 157*b* each include an inlet conduit 206, 214, an entrance valve 207, 215, and a quick release coupling 208, 215, as well as an outlet conduit 210, and 218, each of which likewise includes a quick release coupling 211, 219 and a valve 212 and 220. Bypass valves 222 and 223 are provided in the conduit 184 so that water exiting the charcoal filtration system 152 may be shunted around the deionizer columns 157*a* and 157*b*. A resin trap 224 is provided at the end of the conduit 184 to prevent particles of resin from the deionizer columns 157*a* and 157*b* from entering the polished rinse-water tank 8. This trap 224 includes a 25 micron cartridge type-filter and is flanked by isolation valves 226*a* and 226*b*. A bypass conduit 227 including a bypass valve 228 is connected upstream and downstream of the isolation valves 226*a* and 226*b* flanking the resin trap 224 so that the resin trap 224 may be bypassed during a filer replacement or other maintenance operation.

The polished rinsed water reservoir 8 includes an outlet conduit 230 that leads to the inlet of a pump 232 by way of a valve 234. A level sensor 235 is hydraulically connected to the tank 8 and electrically connected to the pump 232 so that the pump 232 will empty the tank 8 when the water level therein rises to an undesirale level. The outlet of the pump 232 is connected to a flush water conduit 236 having an entrance valve 238, and a check valve 240. When entrance valve 238 is opened, rinse-water 236 may be used to back-wash the charcoal beds 153*a* and 253*b*. The outlet of the pump 232 is further connected to a purifier conduit 242 having an ultraviolet purifier 244. A throttle valve 246 controls the flow of water through the ultraviolet purifier 244, and a flow meter 247 is provided so that the rate of flow may be visually monitored. The ultraviolet purifier 244 is flanked by isolation valves 248*a* and 248*b*, respectively. As was the case with the ultraviolet purified 141, a bypass conduit 249 having a bypass valve 250 is provided so that the purifier 244 may be circumvented during a maintenance operation.

In operation, approximately 250 pounds of garments is loaded into the washing machine 3. Next, between 200 and 250 gallons of wash-water are introduced into the washer 3 from the polished wash-water reservoir 6 by way of conduit 5 and appropriate surfactants are added to the wash-water within the machine 3. The first wash cycle is then commenced. The first wash cycle will last approximately ten minutes. During that period of time, the circulation pump 47 will be actuated in order circulate the wash-water within the machine 3 through one or the other of the filtration banks 16*a* and 16*b*. As the pump 47 has approximately a 50 gallon per minute circulation ate when connected downstream of one or the other of the filtration banks 16*a* and 16*b*, this water will be circulated through each of the filters 20*a*, 22*a* and 24*a* approximately two and a half times by the end of the first wash cycle. Such circulation will remove about 90 per cent of the particulate contaminants dislodged from the clothing by the surfactants.

At the end of the first wash cycle, the wash-water contained within the machine 3 is dumped into the sump 56. Next, three way valve 38 is adjusted so that all the water which flows one last time through the filtration bank 16*a* is routed to the wash collection tank 42. The water in the wash collection tank 42 is filtered an additional time through the wash-water filtration system 67, whereupon it is then passed through the deionizer beds 73*a* and 73*b*. These last two processing steps should remove all of the particulate and dissolved radioactive contaminants in the wash-water. The polished wash-water is then returned to the wash-water reservoir 6, and the wash cycle is repeated.

After all the wash cycles have been repeated, one or more rinse cycles are initiated by actuating the rinse pump 232 to introduce rinse-water into the rinse-water inlet 7. This rinse-water is circulated through the filtration bank 16*a* during the ten minute rinse cycle in the same manner that the wash-water was, and is likewise dumped into the sump 56 at the termination of the rinse cycle. From the sump 56, the rinse-water is routed through the rinse-water outlet conduit 52 by closing valve 50 and by opening valve 53. This step routes the water into the rinse-water collection tank 54, where pump 160 pumps it first through the charcoal filtration system 152, and from thence through the rinse deionizer system 155 where it finally arrives again into the polished rinse-water reservoir 8.

We claim:

1. An apparatus for water washing fabrics and removing particulate radioactive contaminants therefrom comprising:

(a) a washing machine means for washing and rinsing said fabrics having a wash-water inlet, rinse water inlet, a circulation inlet, and a water outlet;

(b) a particulate removal system connected between the circulation inlet and the water outlet for continuously circulating water introduced into the washing machine means through a particulate removal means while said machine means washes and rinses said fabrics, and (c) a hydraulically closed wash-water system and rinse water system connected to the wash-water inlet and the rinse water inlet, respectively, for supplying polished wash-water and polished rinse water to the washing machine means, wherein each system includes its own separate water polisher.

2. An apparatus for water washing fabrics and removing particulate radioactive contaminants as defined in claim 1, wherein said wash-water polisher is connected downstream of the particulate removal means through a first valve means that selectively shunts water flowing out of the particulate removal means from said circulation inlet to said wash-water polisher to supply filtered water to said wash-water polisher.

3. An apparatus for water washing fabrics and removing particulate radioactive contaminants as defined in claim 1, wherein said rinse-water polisher is connected to the water outlet of the washing machine means through a second valve means that selectively shunts water flowing out of the water outlet to supply water to said rinse-water polisher.

4. An apparatus for water washing fabrics and removing particulate radioactive contaminants as defined in claim 1, wherein said particulate removal system includes a pump means for circulating water through said particulate removal means.

5. An apparatus for water washing fabrics and removing particulate radioactive contaminants as defined in claim 4, wherein said particulate removal means includes a filtration means.

6. An apparatus for water washing fabrics and removing particulate radioactive contaminants as defined in claim 5, wherein said filtration means includes a plurality of serially connected cartridgetype filters.

7. An apparatus for water washing fabrics and removing particulate radioactive contaminants as defined in claim 6, wherein the serially connected cartridge-type filters remove successively smaller particulate contaminants from the water circulating through the particulate removal system as said water flows through each of said filters.

8. An apparatus for water washing fabrics and removing particulate radioactive contaminants as defined in claim 7, wherein said washing machine means provides between about 1.5 to 2.0 gallons of water for every pound of fabric being washed.

9. An apparatus for water washing fabrics and removing particulate radioactive contaminants therefrom, comprising:

(a) a washing machine means for washing and rinsing said fabrics having a wash-water inlet, rinse-water inlet, a circulation inlet, and a water outlet;

(b) a particulate removal system connected between the circulation inlet and the water outlet of the washing machine means and including a particulate removal means for continuously circulating water introduced into the washing machine means to remove particulate contaminants therefrom while said machine means washes and rinses said fabrics;

(c) a hydraulically closed wash-water system including a polished wash-water reservoir connected to the wash-water inlet for supplying polished wash-water to the machine means, a wash-water polishing means connected between said reservoir and said particulate removal system downstream of said particulate removal means, and a first valve means for selectively shunting filtered water flowing out of the particulate removal means from said circulation inlet to said wash-water polishing means; and (d) a hydraulically closed rinse-water system including a polished rinse-water reservoir connected to the rinse-water inlet for supplying polished rinse-water to the machine means, a rinse-water polishing means connected between said rinse-water reservoir and the washer outlet of the washing machine means at a point upstream of said particulate removal system, and a second valve means for selectively shunting water flowing out of said water outlet of said machine means to said rinse-water polishing means.

10. An apparatus for water washing fabrics and removing particulate radioactive contaminants as defined in claim 9, wherein said particulate removal system includes pump means for circulating water through said particulate removal means.

11. An apparatus for water washing fabrics and removing particulate radioactive contaminants as defined in claim 10, wherein said particulate removal means includes serially connected filtration means.

12. An apparatus for water washing fabrics and removing particulate radioactive contaminants as defined in claim 11, wherein the serially connected filtration means remove successively smaller particulate contaminants from the water circulating through the particulate removal system as said water flows through each of said filtration means.

13. An apparatus for water washing fabrics and removing particulate radioactive contaminants as defined in claim 12, wherein said filtration means includes a first cartridge-type filter capable of removing particles 25 microns in length, a second cartridge-type filter capable of removing particles five microns in length, and a third cartridge-type filter capable of removing particles 1 micron in length.

14. An apparatus for water washing fabrics and removing particulate radioactive contaminants as defined in claim 10, wherein said pump means circulates the wash-water contained with the washing machine means at least once per wash cycle.

15. An apparatus for water washing fabrics and removing particulate radioactive contaminants as defined in claim 8, wherein said washing machine means provides between about 1.5 to 2.0 gallons of water for every pound of fabric being washed.

16. An apparatus for water washing fabrics and removing particulate radioactive contaminants as defined in claim 15, wherein said washing machine means is capable of was a maximum of 300 pounds of clothes at one time.

17. An apparatus for water washing fabrics and removing particulate radioactive contaminants as defined in claim 9, wherein said wash-water polishing means includes a wash-water filtration means, and a wash-water deionizer means serially connected together, and a third valve means for shunting the flow of wash-water leaving the wash-water filtration means away from the deionizer means and into said wash-water reservoir.

18. An apparatus for water washing fabrics and removing particulate radioactive contaminants as defined in claim 9, wherein said hydraulically closed rinse-water system includes a charcoal filtration means for removing residual surfactants from said rinse-water, and a valve for selectively diverting rinse-water leaving said charcoal filtration means into said hydraulically closed wash-water system to make-up water losses in said wash-water system.

19. An apparatus for water washing fabrics and removing particulate radioactive contaminants therefrom, comprising:

a. a washing machine means for washing and rinsing said fabrics having a wash-water inlet, rinse-water inlet, a circulation inlet, and a water outlet;

b. a particulate removal system connected between the circulation inlet and the water outlet for continuously circulating water introduced into the washing machine means through a particulate removal mean while said machine means washes and rinses said fabrics;

c. a hydraulically closed wash-water system including a polished wash-water reservoir connected to the wash-water inlet for supplying polished wash-water to the washing machine means, and a wash-water polisher connected to the wash-water reservoir, and d. a hydraulically closed rinse-water system including a polished rinse-water reservoir connected to the rinse water inlet for supplying polished rinse-water to the washing machine means, and a rinse-water polisher connected to the rinse-water reservoir.

* * * * *